US006652293B2

(12) United States Patent
Fuchs et al.

(10) Patent No.: US 6,652,293 B2
(45) Date of Patent: Nov. 25, 2003

(54) CABLE-END CONNECTOR WITH ACTIVE CIRCUIT ELEMENTS

(75) Inventors: Helmut Fuchs, Halver (DE); Wolfgang Conrad, Schalksmühle (DE)

(73) Assignee: Lumberg Automation Components GmbH & Co. KG, Schalksmuhle (DE)

( * ) Notice: Subject to any disclaimer, the term of this patent is extended or adjusted under 35 U.S.C. 154(b) by 0 days.

(21) Appl. No.: 10/224,298

(22) Filed: Aug. 20, 2002

(65) Prior Publication Data

US 2003/0054693 A1 Mar. 20, 2003

(30) Foreign Application Priority Data

Aug. 21, 2001 (DE) ..... 101 40 910

(51) Int. Cl.[7] ..... H01R 12/00

(52) U.S. Cl. ..... 439/76.1; 439/881; 439/694; 439/902; 439/425

(58) Field of Search ..... 439/76.1, 881, 439/694, 902, 425

(56) References Cited

U.S. PATENT DOCUMENTS 4,959,024 A 9/1990 Czeschka
5,277,624 A 1/1994 Champion
5,441,423 A 8/1995 Champion
5,833,475 A 11/1998 Mitra
6,126,494 A * 10/2000 Fuchs et al. ..... 439/835
6,312,281 B1 * 11/2001 Rodriguez ..... 439/394

FOREIGN PATENT DOCUMENTS

DE 42 22 685 1/1994

* cited by examiner

*Primary Examiner*—Tho D. Ta
(74) *Attorney, Agent, or Firm*—Herbert Dubno; Andrew Wilford

(57) ABSTRACT

An electrical connector is used in combination with an electrical circuit board having an active element and formed with a row of throughgoing contact holes and a multiconductor cable having a plurality of wires each having a core conductor. The connector has a dielectric body formed with a row of parallel and outwardly open contact seats, a row of parallel and outwardly open wire seats aligned with and extending transversely across the contact seats, and an outwardly open pocket traversed by the contact seats and dimensioned to hold the circuit board with its holes aligned with the contact seats. Respective contacts in the contact seats each have a pointed tip engaged through the respective hole of the board in the seat and poking in the respective wire seat into the respective wire and into contact with the conductor thereof.

9 Claims, 6 Drawing Sheets

CABLE-END CONNECTOR WITH ACTIVE CIRCUIT ELEMENTS

FIELD OF THE INVENTION

The present invention relates to cable-end connector. More particularly this invention concerns cable-end connector that incorporates at least one active circuit element, e.g. a printed-circuit board carrying a light-emitting diode.

BACKGROUND OF THE INVENTION

The end of a multiconductor cable connected to, for instance, a proximity detector is fitted to a connector that itself is adapted to mate with a standardized plug or fit in a standardized socket. The individual conductors of the cable are connected electrically to respective contacts in the body of the connector.

In many applications, for instance the above-cited proximity detector or local-area-network wiring, it is useful to provide the cable-end connector with some active circuit elements that monitor electrical activity in the cable and even provide some indication of such activity. Thus a tiny circuit board carrying various active elements is mounted in the cable-end connector and a window is provided so that a light-emitting diode (LED) on the circuit board can provide a visual indication of line activity.

German patent 4,222,685 of G. Wehrle described a prior-art system where the conductors of the cable are soldered to contacts that themselves are fitted in and soldered to a printed circuit board that is imbedded beneath a clear plastic resin in the body of the connector. This patent document also describes a system where the contacts are tubular and have ends each formed with a stepped notch. A wider outer end of each notch is slightly narrower than the overall width of the respective wire and the narrower inner end is slightly narrower than the diameter of the respective conductor. Thus to make the connection the unstripped end of each wire of the multiconductor cable is shoved down into the respective contact and then bent over and fitted to the respective notch. Then the notched end is fitted tightly into a hole of a circuit board, thereby forcing the respective wire down so that the respective notch cuts through the wire's insulation and the sides of the narrow inner portion of the notch come into solid electrical contact with the contact.

While this latter arrangement avoids the complexity of having to make two solder joints for each conductor, it still represents a relatively complex system. Installation is somewhat laborious, requiring each conductor to be fitted in place and then bent over individually.

OBJECTS OF THE INVENTION

It is therefore an object of the present invention to provide an improved cable-end connector.

Another object is the provision of such an improved cable-end connector which overcomes the above-given disadvantages, that is which is extremely easy and simple to put together, yet which forms a solid electrical and mechanical connection between each conductor and the respective contact and with the printed-circuit board.

SUMMARY OF THE INVENTION

These objects are attained according to the invention in an electrical connector used in combination with an electrical circuit board having an active element and formed with a row of throughgoing contact holes and a multiconductor cable having a plurality of wires each having a core conductor. The connector has according to the invention a dielectric body formed with a row of parallel and outwardly open contact seats, a row of parallel and outwardly open wire seats aligned with and extending transversely across the contact seats, and an outwardly open pocket traversed by the contact seats and dimensioned to hold the circuit board with its holes aligned with the contact seats. Respective contacts in the contact seats each have a pointed tip engaged through the respective hole of the board in the seat and poking in the respective wire seat into the respective wire and into contact with the conductor thereof.

The assembly of this connector is extremely simple. The conductors are pushed all the way into their seats and the circuit board all the way into its pocket, then the contacts are pressed into place. As each contact moves into its end position its tip passes through the respective hole in the circuit board, locking the board in place, then pierces into the respective wire, locking the wire in place and making a good electrical connection with the wire's conductor. The contacts can be premounted in a position not extending into the board pocket or conductor seats, so that once the board and conductors are in place, they need merely be pushed home to complete the assembly.

The circuit-board holes are conductively lined and the contacts have portions adjacent their tips in electrical contact with the respective holes. Thus once the contacts are pushed home, they make the necessary connection between the circuit board and the conductor also. Of course some of the holes can be unlined so that the respective contacts only are connected to one of the conductors. The contact portions are widened and bear laterally elastically on the respective lined holes, something made easy by splitting and spreading the sheet metal forming the contacts.

The body in accordance with the invention has a connector part formed with the contact seats and a grip part formed with the pocket and conductor seats. In addition it is formed with a large-diameter seat dimensioned to loosely receive the cable and into which the conductor seats open. The conductor seats have outwardly flared ends at the large-diameter seat. This makes fitting the wires into the conductor seats easy.

A mass of thermoplastic fills the pocket around the circuit board. The cable is imbedded in the mass also. In fact the mass fills the enlarged seat around the cable to provide strain relief. When the active element is an LED, the mass is at least limitedly transparent. Thus the LED can be seen to monitor, for instance, operation of a sensor connected to the cable.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
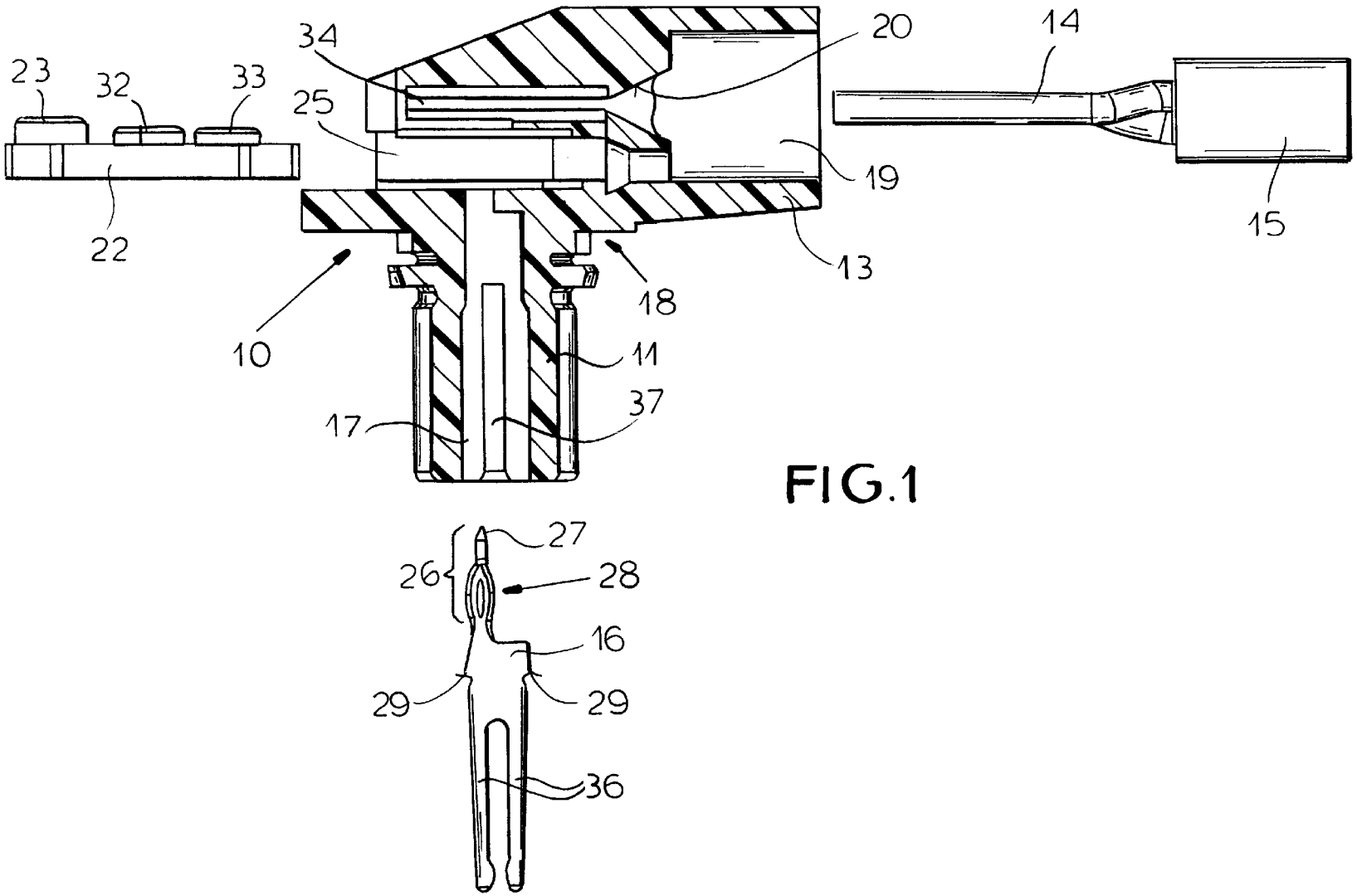
FIG. 1 is an exploded sectional view of the cable-end connector according to the invention.

As seen in FIG. 1 an electrical connector 10 is adapted to be secured to the end of a multiconductor cable 15 having a plurality of wires 14 each having a core conductor 35 (FIG. 4) surrounded by a plastic sheath 38. The connector 10 has a one-piece, L-shaped, molded plastic body 18 that receives the end of the cable 15 as well as a plurality of contacts 16 and a printed circuit board 22. The board 22 is formed with copper-lined throughgoing contact holes 24 and carries circuit elements including at least one LED 23 and other resistors and such shown at 32 and 33.

The molded plastic body 18 of the connector 10 has a plug part 11 having a notch 37 shaped to fit a flat circuit-board type connector and formed along the notch 37, which extends perpendicular to the view plane of FIG. 1, formed with a row of identical passages or seats 17 each adapted to hold a respective one of the contacts 16. A standard mounting nut 12 (FIGS. 4 and 5) is fitted over this part 11. The body 18 also has an outer grip part 13 formed with a plurality of parallel seats or passages 34 extending perpendicular to the respective passages 17 and of a diameter slightly greater than that of the wires 14 so same can fit smoothly and easily into them. Thus a plane defined by center axes of the seats 17 is perpendicular to a plane defined by center axes of the seats 34.

The part 13 also forms at the outer ends of the seats 34 an outer large-diameter seat 19 into which the cable 15 fits with substantial play, and the outer portion of each passage 34 is flared at 20 to facilitate fitting the wires 14 of the cable 15 into the respective passages 34. Finally, the connector body 18 is formed underneath the row of passages 34 with a pocket 25 shaped to receive the circuit board 22 with slight play, in a position with the holes 24 aligned with the respective passages 17. The pocket 25 opens oppositely to the seats 19 and 34.

Each contact 16 is formed as a basically flat piece of metal, typically copper-coated steel, and is intended to fit wholly in a respective one of the passages 17. Each contact 16 has a pair of legs 36 that straddle the notch 37 and are adapted to make contact with an unillustrated plug fitted to the notch 37 and secured in place by the nut 12. An inner end 26 of each contact 16 has an pointed tip 27 and a split and spread portion 28 immediately adjacent this point 27. Furthermore each contact 16 is formed with barbs 29 that can dig into and anchor it in the respective passage seat 17.

Such a connector 10 is assembled by first fitting the contacts 16 to the respective seats 17 only partially, that is with the tips 27 not projecting into the pocket 25. This position is not illustrated.

Figure 2:
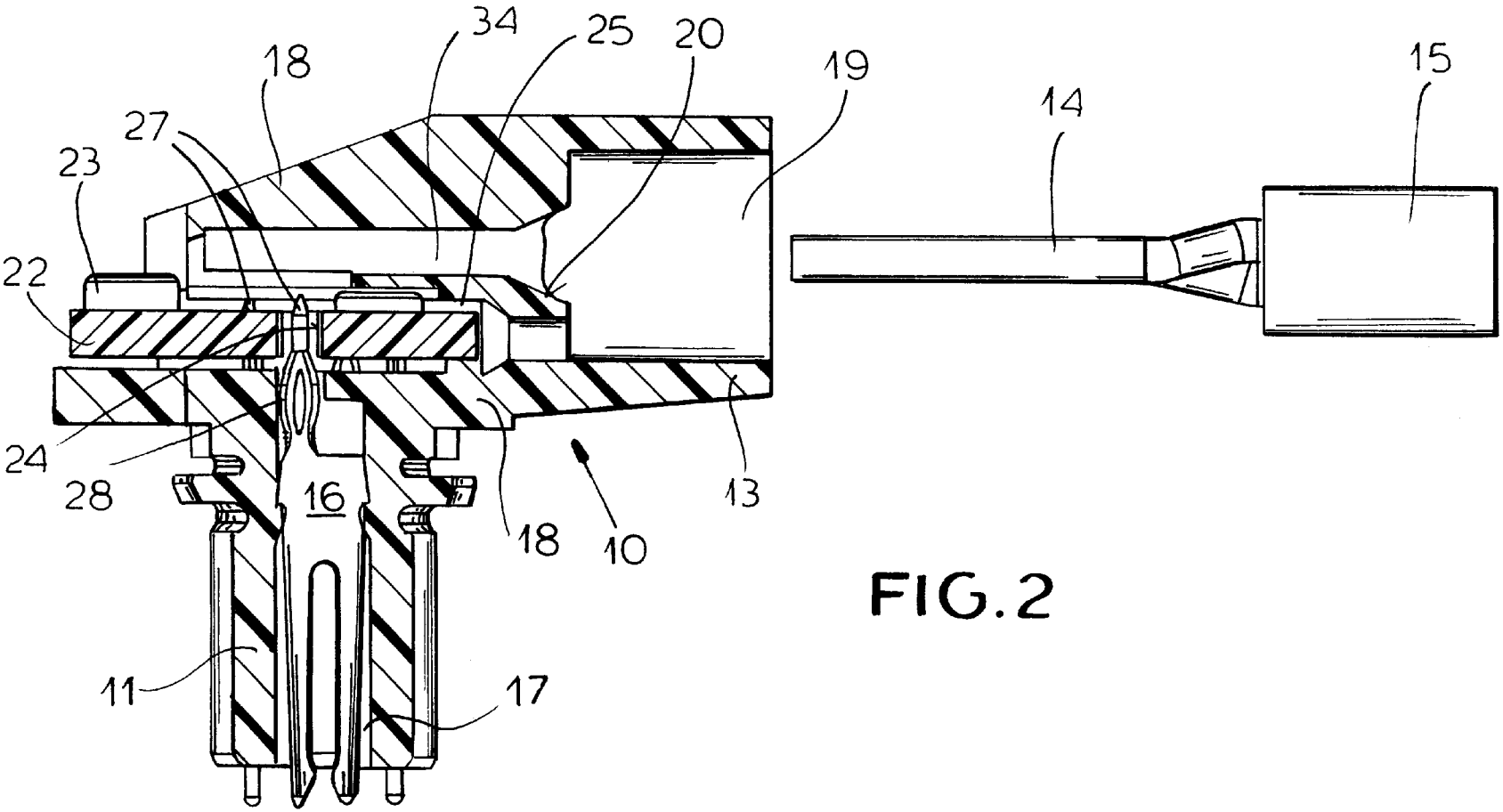
FIGS. 2 and 3 are sectional views showing the connector at successive steps in assembly.

Then as shown in FIG. 2 the circuit board 22 is fitted to the pocket 25 to align its lined conductor holes 24 with the passages 17, and the contacts 16 are pushed in enough to fit their tips 27 through the holes 24. This anchors the circuit board 22 in place.

Figure 3:
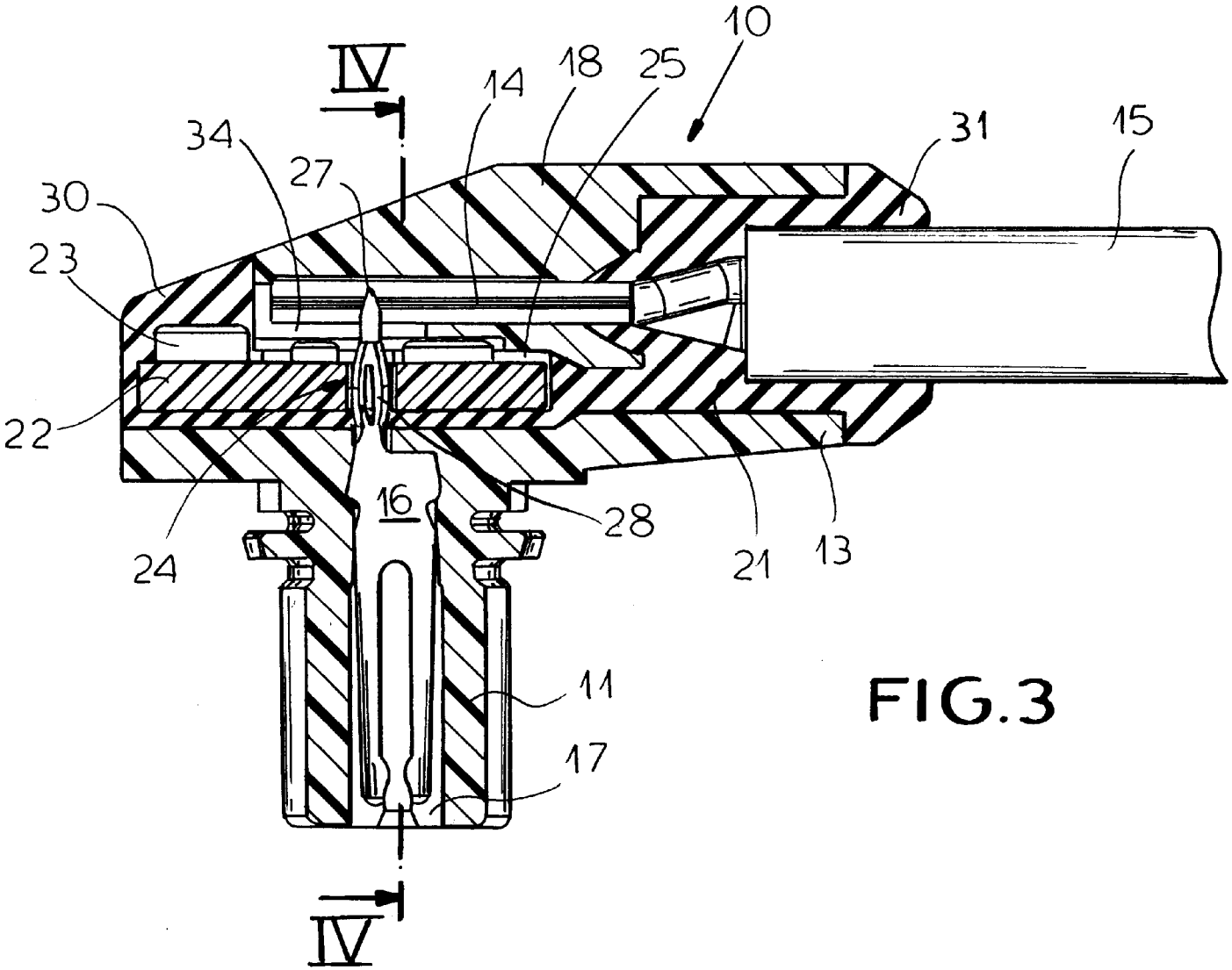
Figure 4:
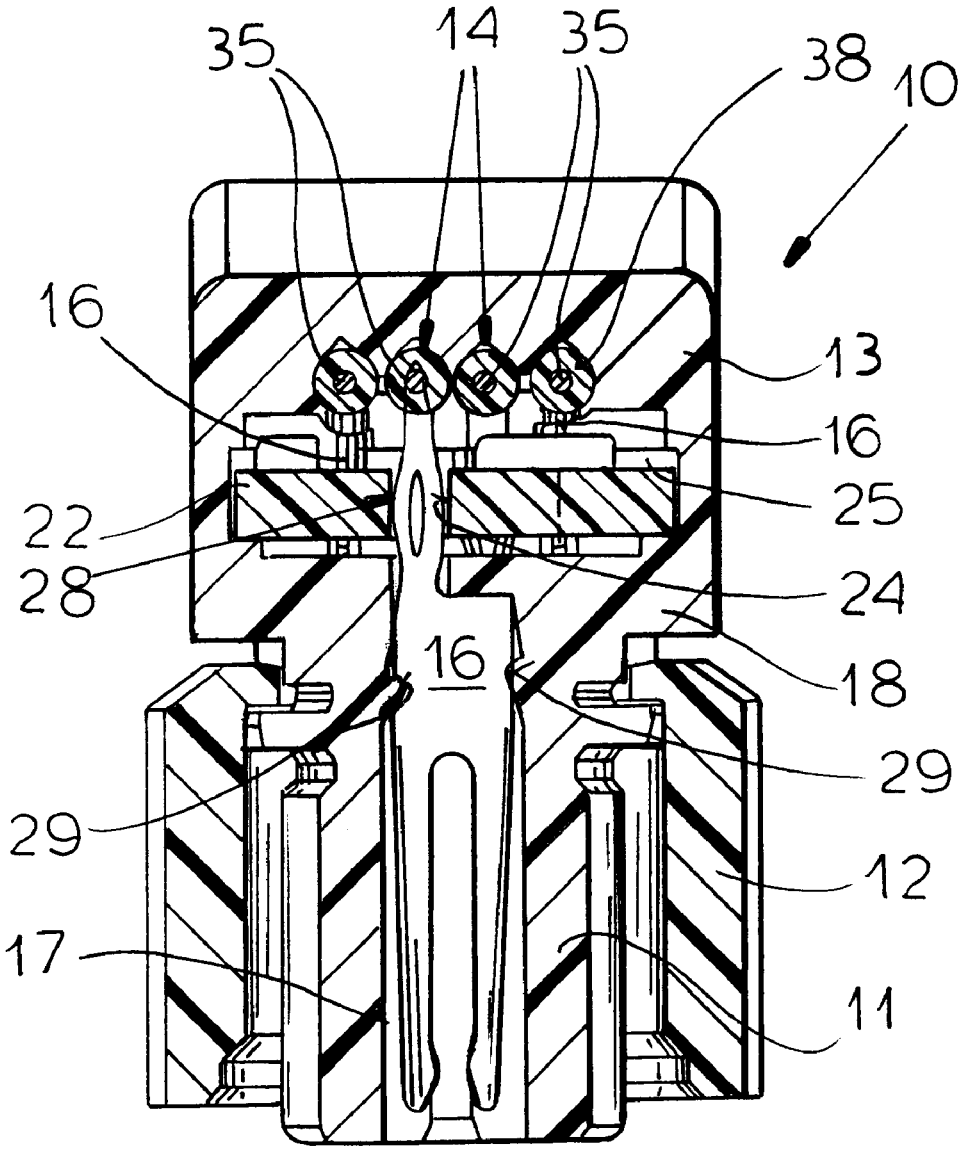
FIG. 4 is a section taken along line IV—IV of FIG. 3.
Figure 5:
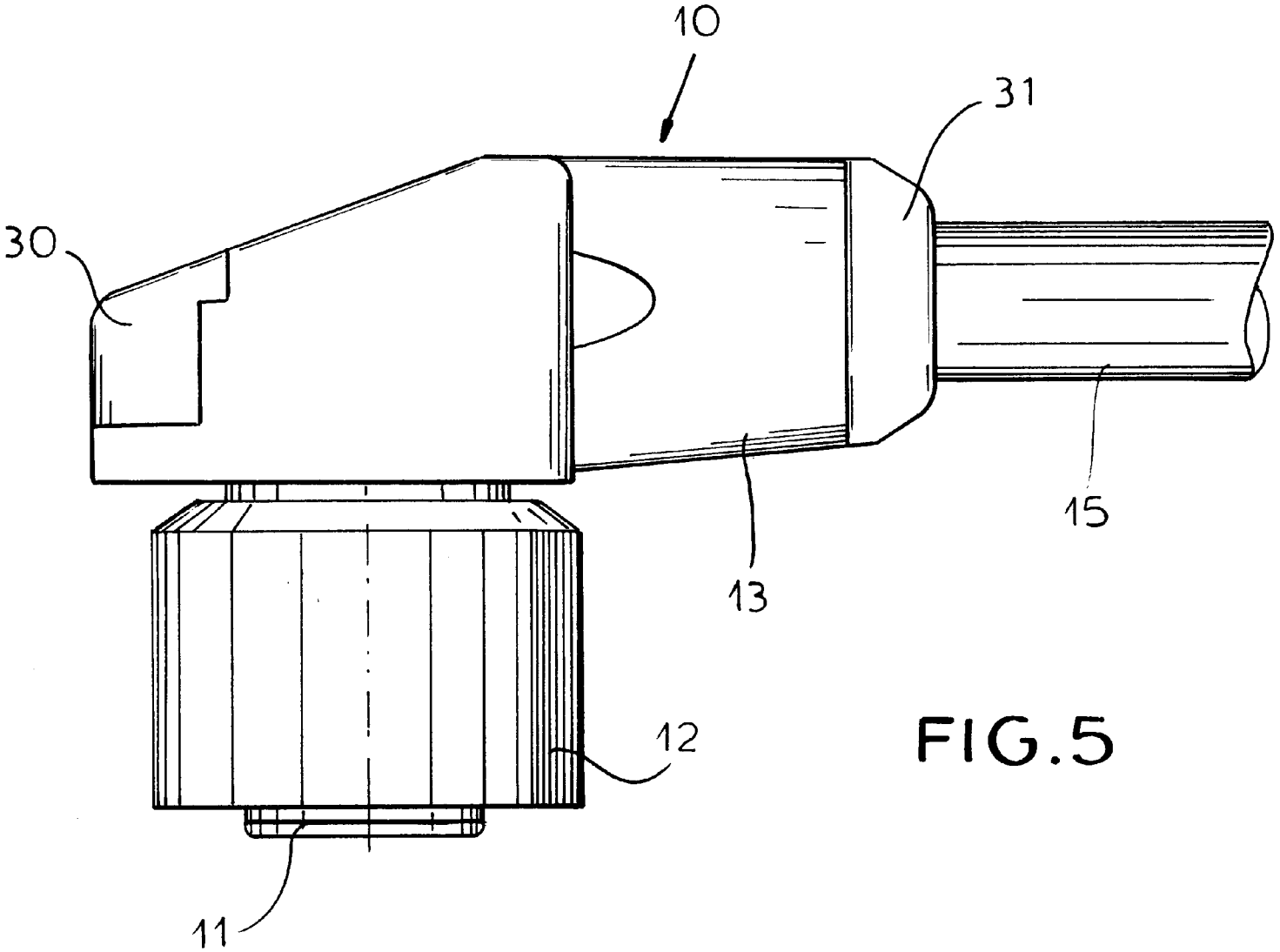
FIGS. 5 and 6 are side and top views of the finished connector.
Figure 6:
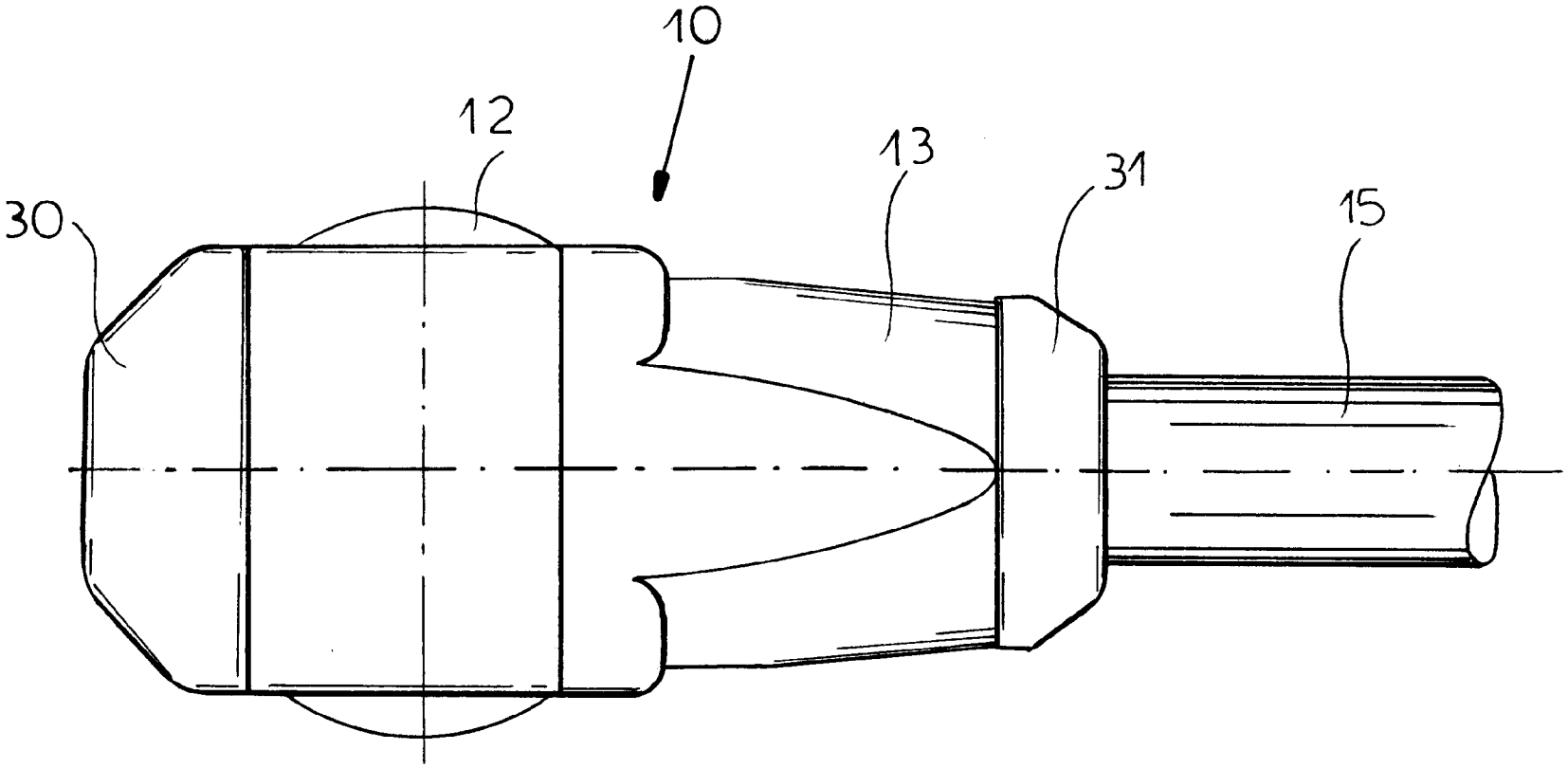

Subsequently as shown in FIGS. 3 and 4 the cable 15 is pushed into the seat 19 with its multiple wires 14 each engaging in a respective one of the passage seats 34. The contacts 16 are then pushed all the way in, thereby piercing through the wires 14 with their points 27 to make good electrical contact with the conductors 34 therein, while also forcing the spread portions 28 into the respective holes 24 and forming good electrical contact therewith and with the circuit elements 23, 32, and 33 connected thereto. The barbs 29 dig into the sides of the respective seats 17 to solidly lodge the contacts 16 therein. Then the assembly is fitted to a mold that is filled with a hardenable transparent synthetic resin to form as shown in FIGS. 5 and 6 a body 30 that covers the circuit board 22 while still leaving its LED's 23 visible, and filling the seat 19 around the cable 15 at 31 to solidly anchor the cable 15 and provide strain relief.

The connector therefore can be assembled without soldering, but ensures excellent electrical contact between the contacts 16 and the elements 23, 32, and 33 of the circuit board 22 and the respective conductors 35. Once potted in the resin as shown at 30 and 31, the connector 10 is extremely rugged. The LED's 23 remain visible so as to provide a display of the function of the circuit element, e.g. a proximity detector or other sensor, connected to the cable 15.

We claim:

1. In combination with an electrical circuit board having an active element and formed with a row of throughgoing contact holes, and a multiconductor cable having a plurality of wires each having a core conductor, an electrical connector comprising:

a dielectric body formed with a row of parallel and outwardly open contact seats, a row of parallel and outwardly open wire seats aligned with and extending transversely across the contact seats, and an outwardly open pocket traversed by the contact seats and dimensioned to hold the circuit board with its holes aligned with the contact seats; and respective contacts in the contact seats and each having a pointed tip engaged through the respective hole of the board in the seat and poking in the respective wire seat into the respective wire and into contact with the conductor thereof, the contacts being movable from an outer position with their tips outward of the pocket and conductor seats and an inner position with their tips in the conductor seats.

2. The electrical connector defined in claim 1 wherein the body has a connector part formed with the contact seats and a grip part formed with the pocket and conductor seats.

3. The electrical connector defined in claim 1 wherein the circuit-board holes are conductively lined and the contacts have portions adjacent their tips in electrical contact with the respective holes.

4. The electrical connector defined in claim 3 wherein the contact portions are widened and bear laterally elastically on the respective lined holes.

5. The electrical connector defined in claim 1 wherein the body is further formed with a large-diameter seat dimensioned to loosely receive the cable and into which the conductor seats open.

6. The electrical connector defined in claim 5 wherein the conductor seats have outwardly flared ends at the large-diameter seat.

7. The electrical connector defined in claim 1, further comprising a mass of thermoplastic filling the pocket around the circuit board, the cable being imbedded in the mass also.

8. The electrical connector defined in claim 7 wherein the active element is a light-emitting diode and the mass is at least limitedly transparent.

9. The electrical connector defined in claim 7 wherein the body is further formed with a large-diameter seat dimensioned to loosely receive the cable and into which the conductor seats open, the mass filling the large-diameter seat around the cable.

* * * * *